US005560725A

United States Patent [19]

Abergel

[11] Patent Number: 5,560,725

[45] Date of Patent: Oct. 1, 1996

[54] DEVICE FOR FEEDING A CONTINUOUS ROLLED STRIP OF PRINTING SUBSTRATE TO A LASER PRINTER NOT OTHERWISE CONFIGURED THEREFOR

[75] Inventor: Edmond Abergel, Sainte Genevieve Des Bois, France

[73] Assignee: M.G.I., Vitry Sur Seine, France

[21] Appl. No.: 256,682

[22] PCT Filed: Jan. 20, 1993

[86] PCT No.: PCT/FR93/00053

§ 371 Date: Jul. 20, 1994

§ 102(e) Date: Jul. 20, 1994

[87] PCT Pub. No.: WO93/13946

PCT Pub. Date: Jul. 22, 1993

[30] Foreign Application Priority Data

Jan. 21, 1992 [FR] France ..... 92 00605

[51] Int. Cl.[6] ..... B41J 11/70

[52] U.S. Cl. ..... 400/621

[58] Field of Search ..... 400/618, 621, 400/621.2; 101/226, 227

[56] References Cited

U.S. PATENT DOCUMENTS

| | | | |
|---|---|---|---|
| 3,622,425 | 11/1971 | Savarick | 156/505 |
| 4,088,256 | 5/1978 | Potma et al. . | |
| 4,216,719 | 8/1980 | Flaceliere | 400/621 |
| 4,234,261 | 11/1980 | Hendrischk et al. . | |
| 4,478,143 | 10/1984 | Hendrischk et al. . | |
| 4,895,466 | 1/1990 | Hartman et al. | 400/621 |
| 4,900,174 | 2/1990 | Didiergeorge | 400/621 |
| 4,957,381 | 9/1990 | Sakai et al. | 400/621 |
| 5,025,725 | 6/1991 | Fukino | 400/621 |
| 5,174,670 | 12/1992 | Takagi et al. | 101/226 |
| 5,181,801 | 1/1993 | Durler | 400/708 |

FOREIGN PATENT DOCUMENTS

| | | |
|---|---|---|
| 0212754 | 3/1987 | European Pat. Off. . |
| 2328510 | 1/1975 | Germany . |

OTHER PUBLICATIONS

By J. Bateson et al., "Dual-Motor Forms Feed Drive", IBM Technical Disclosure Bulletin, Dec. 1979, vol. 22, No. 7, pp. 2616 and 2617.

*Primary Examiner*—Ren Yan

*Attorney, Agent, or Firm*—Young & Thompson

[57] ABSTRACT

A device for feeding a continuous rolled strip (5) of printing substrate to a laser printer (10) not designed for this purpose and for delivering the strip (5) in a predetermined format. There is an input (12) and an output (14) of the printer (10). Each input and output comprises a cutter (32, 34) for the said strip (5) and a device for measuring the length of the strip (5) between two successive cuts. The measuring device actuates the cutters upon the detection by the measuring device of a predetermined length of strip (5) between cuts. The measuring device detects a cut end of the strip (5).

10 Claims, 1 Drawing Sheet

DEVICE FOR FEEDING A CONTINUOUS ROLLED STRIP OF PRINTING SUBSTRATE TO A LASER PRINTER NOT OTHERWISE CONFIGURED THEREFOR

FIELD OF THE INVENTION

The present invention concerns a device for feeding a rolled strip of printing substrate to a laser printer and for delivering the strip in a predetermined format.

BACKGROUND OF THE INVENTION

It is well known that the laser type printers for professional use normally available on the market do not accept a continuous strip of printing substrate. Only very high-quality laser type printers accept the feeding of a continuous strip of substrate under certain conditions.

A printer of this type is described in document DE-A-4025177, for example. In practice, the printer described in this document accepts the continuous feeding of a paper referred to as detachable feed pin paper which comprises lateral perforations on both sides of the sheet and transversal perforations of a specific length making it possible to later separate the strip into conventional pages. This document describes the detection of the transversal perforations making it possible to determine the point where the strip must stop in the course of each successive printout.

Document DE-A-3313404 also describes the continuous feeding of a laser type printer and is more specifically concerned with a device making it possible to slacken the strip of substrate at the printer input. It therefor does not describe a solution for feeding a laser type printer not designed for this purpose with a continuous rolled strip of printing substrate and for delivering the strip in a predetermined format.

Document U.S. Pat. No. 4,478,143 describes a special matrix printer making it possible to have the paper input and output on the same side, with a continuous feeding of the paper. The problem encountered with a laser type printer is quite peculiar since such a printer does not accept all substrate formats, contrarily to a matrix printer.

OBJECT OF THE INVENTION

The objective of the present invention is thus to provide a device making it possible to use a conventional laser type printer to print on a substrate of a specific format which under normal conditions is not accepted by the printer.

SUMMARY OF THE INVENTION

According to the invention, the feed and delivery device comprises a means of input and a means of output respectively placed at the input and at the output of the printer, and each comprising a means of guillotining and cutting the strip and a means of measuring the length of said strip between two successive cuts.

According to one embodiment, the measuring means consists of a guide of which one face easily receives the strip, with this face having a determined length and/or a means of detecting the strip, such as a photoelectric cell or a microswitch.

According to another embodiment, the measuring means consists of a phonic wheel driven to rotation by the strip or by a transcoder.

Preferably, the means of input is placed below the printer, a guide being provided to guide the paper towards the printer input, whereas the means of output is placed above the printer, with a tray for receiving the cut substrate available beyond the means of output.

BRIEF DESCRIPTION OF THE DRAWINGS

The present invention and its other objectives, advantages and characteristics will be more clearly understood upon reading the description which follows of the preferred embodiments (provided on a non limiting basis), in connection with the accompanying drawings, in which.

DETAILED DESCRIPTION OF THE INVENTION

Figures 1, 2:
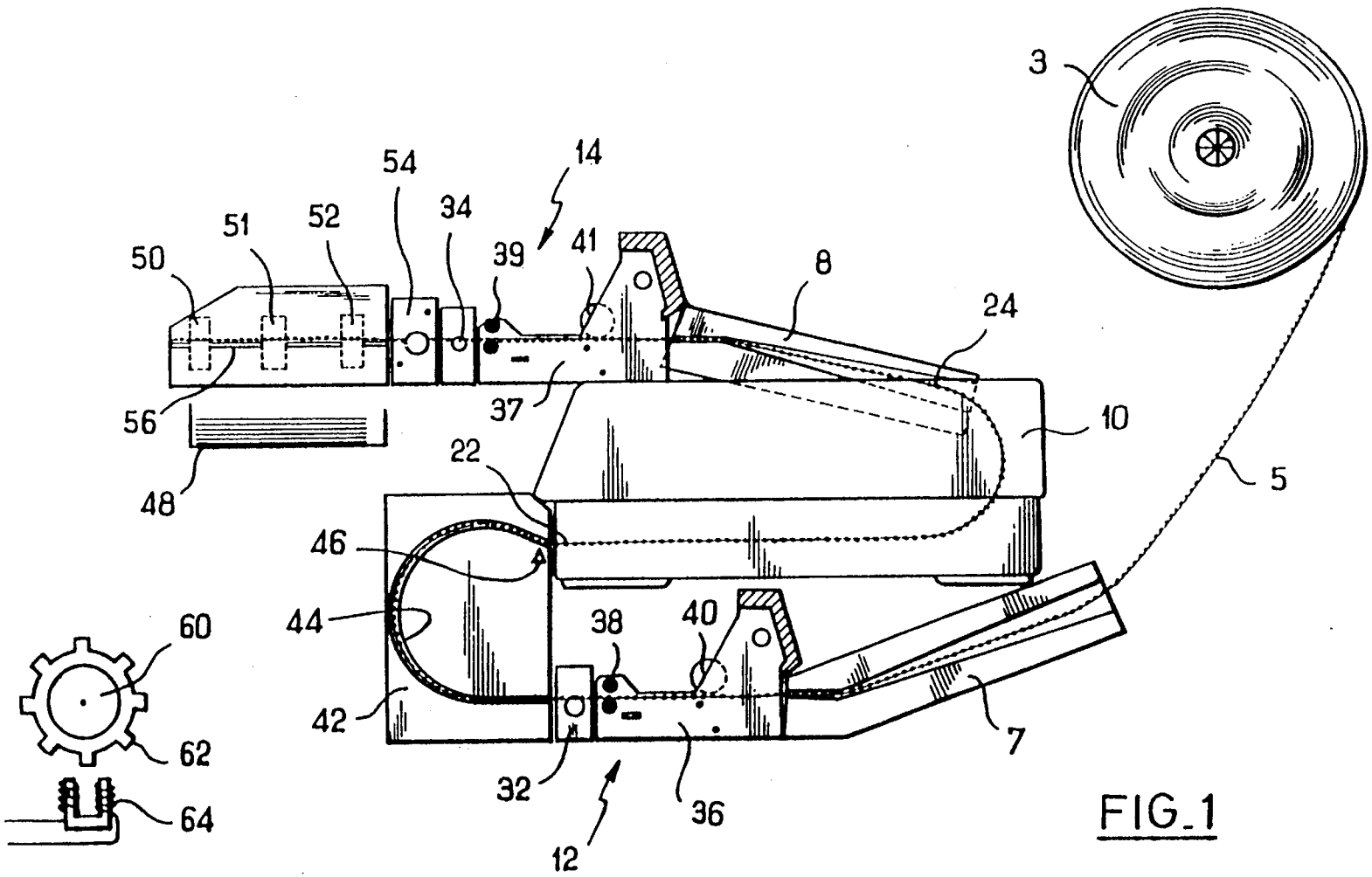
FIG. 2 PRIOR ART
FIG. 1 is a cross-sectional drawing of the feed and delivery device according to the present invention, associated to a laser type printer not designed for this purpose.
FIG. 2 is a drawing of a preferred measuring means which can be used with the device shown in FIG. 1.

Referring now to FIG. 1 in particular, the printer 10 is shown without details since it is a conventional printer of the type available on the market.

In brief, the continuous strip 5 is formed into a roll 3 and first enters a guide 7 from which it penetrates a means of input 12 at the output of which a guide 42 is provided to guide the strip towards the input 22 of the printer 10. At the output 24 of the printer 10, the strip first reaches a guide 8 and then the means of output 14. The means of input 12, like the means of output 14, mainly comprises a means of guillotining 32, 34 and a means for measuring the length of the strip between two successive cuts.

In the example shown, the two means of input and output 12, 14 each further comprise, before the guillotining means, a means of stretching 36, 37 the strip. This stretching means, which also drives the strip, comprises at least two driving rollers 38, 40 for the stretching means 36, and 39, 41 for the stretching means 37, turning at different speeds. This stretching means enables the strip 5 to acquire a substantially flat shape before and after passing through the printer 10. This is particularly useful when the strip of printing substrate consists of cardboard, which can be useful for making cards, for example.

The means of output 14 further comprises a driving device 54 making it possible for the strip, after having been cut by the guillotining means 34, to be driven towards the reception tray 48 provided beyond the means of output 14.

In the example shown in FIG. 1, the measuring means consists of a guide 42 for the strip 5, of which one face 44 easily receives the strip 5, with a means of detecting 46 the arrival of the strip provided at a determined distance from the guillotining means 32. This means of detection 46 is preferably a photoelectric cell or a microswitch or any other equivalent means. Hence, when the strip enters the guide 42, as soon as its end is detected by a means of detection 46, a command is given to the guillotining means 32 to cut the strip transversely. The length of cut strip is then seized at the input 22 of the printer 10 with the usual means available to the printer in which the cut strip is to be printed. Obviously, the length of strip thus cut corresponds exactly to the maximum length of substrate accepted by the printer.

Alternatively, the measuring means can consist, as shown in FIG. 2, of a conventional phonic wheel 60 driven by the strip of paper and placed, for example, between rollers 38 and 40 of the means of stretching 36 the strip. Typically, a phonic wheel 60 consists of a wheel comprising teeth 62 which vary the airgap in an electromagnetic coil 64. Thus, when the strip 5 advances, a conventional electronic device can count the number of teeth which pass in front of the coil 64 in order to precisely determine the displacement of the strip 5 and command the guillotining means 32 to cut the strip 5. Either one of the two measuring means can also be found in the means of output 14. Here however, as shown, three means of detection 50, 51, 52 are provided in order to make it possible to cut the strip at the printer output in various possible formats. In the example shown, the three means of detection consist of photoelectric cells, with a guide 56 provided to ease the passage of the cut strip 5 in front of the photoelectric cell. Nevertheless, as in the case of the means of input 12, it is also possible to use a phonic wheel 60 such as that shown in FIG. 2 placed, for example, between rollers 39 and 41 of the stretching means 37.

Those skilled in the art will have understood that the device according to the invention makes it possible to use any laser type printer available on the market, and more specifically the bottom of the line laser type printers used in offices. Equipped according to the invention, the laser type printer can thus print documents in a format quite different from those authorised by the printer itself. Thus, one of the possible applications of the device according to the invention is the making of professional, best wishes or equivalent types of cards requiring a cardboard substrate and a very particular format.

Although only preferred embodiments of the invention have been described and shown, it is obvious that any modification made along the same lines will fall within the scope of the present invention.

In particular, strip guides can be provided in a manner different to those shown. A device for measuring the tension of the strip 5 before reaching the device can be provided and the device can also include a means of indicating that the end of the strip 5 has been reached. This measuring means may include a transcoder.

I claim:

1. In combination with a laser printer (10) not designed to receive a continuous strip of printing substrate, a device for feeding a continuous rolled strip (5) of printing substrate to said laser printer (10) and for delivering the said strip (5) in a predetermined format, said feeding and delivering device comprising a means of input (12) and a means of output (14) respectively placed at an input (22) and at an output (24) of the said printer (10); each means of input and output comprising means of repeatedly cutting (32, 34) the said strip (5) and means for measuring the length of the said strip (5) between two successive cuts, wherein said measuring and cutting means (46; 32) of said input cuts the strip (5) to the maximum length of substrate accepted by the printer (10), and said measuring and cutting means (50, 51, 52; 34) of said output cuts the strip (5) again to one of a plurality of shorter lengths selected by a user of the printer (10).

2. Feed and delivery device according to claim 1, wherein said means of input (12) and output (14) further comprise, before the said cutting means (32, 34), a means of stretching (36, 37) the said strip.

3. Feed and delivery device according to claim 2, wherein said stretching means (36, 37) comprises at least two driving rollers (38, 40; 39, 41) turning at different speeds.

4. Feed and delivery device according to claim 1, wherein said measuring means comprises at least one means of detecting (46, 50, 51, 52) the said strip.

5. Feed and delivery device according to claim 4, wherein said means of detection (46, 50, 51, 52) is a photoelectric cell.

6. Feed and delivery device according to claim 4, wherein said means of detection (46) is a microswitch.

7. Feed and delivery device according to claim 4, wherein said measuring means further comprises a guide (42) of which one face (44) easily receives the strip (5), said face (44) having a determined length.

8. Feed and delivery device according to claim 1, wherein said means of input (12) is placed below the said printer (10), a guide (42) being provided to guide said strip towards the input (22) of the said printer (10), whereas the said means of output (14) is placed above the said printer (10), with a tray (48) for receiving the cut strip beyond the said means of output (14).

9. Feed and delivery device according to claim 1, wherein said measuring means actuates said cutting means upon the detection by said measuring means of a predetermined length of said strip (5) between cuts.

10. Feed and delivery device according to claim 9, wherein said measuring means detects a cut end of said strip (5).

* * * * *